United States Patent [19]

Berg et al.

[11] Patent Number: 4,958,957

[45] Date of Patent: Sep. 25, 1990

[54] SYSTEM FOR UNDERGROUND STORAGE AND DELIVERY OF LIQUID PRODUCT, AND RECOVERY OF LEAKAGE

[75] Inventors: Robin Berg, Hudson, Wis.; Lawrence Mohns, Media, Pa.; Richard Oswald, Elverson, Pa.

[73] Assignee: Sun Refining & Marketing Company, Philadelphia, PA

[21] Appl. No.: 317,565

[22] Filed: Mar. 1, 1989

[51] Int. Cl.[5] ..... B65G 5/00

[52] U.S. Cl. ..... 405/55; 405/53; 405/52; 220/18; 220/426; 220/85 F

[58] Field of Search ..... 405/52, 53, 54, 55, 405/56, 57, 58, 59; 220/18, 426, 429, 85 R, 85 F, 85 VR

[56] References Cited

U.S. PATENT DOCUMENTS

| | | | |
|---|---|---|---|
| 2,916,179 | 12/1959 | Monroe | 220/429 |
| 4,639,164 | 1/1987 | Pugnale et al. | 405/54 |
| 4,659,251 | 4/1987 | Petter et al. | 405/52 |
| 4,682,911 | 7/1987 | Moreland | 405/53 |
| 4,696,330 | 9/1987 | Raudman et al. | 220/85 F X |
| 4,717,036 | 1/1988 | Dundas et al. | 220/18 |
| 4,747,453 | 5/1988 | Howard, Sr. | 220/18 X |
| 4,781,777 | 11/1988 | Pugnale et al. | 220/426 X |
| 4,793,387 | 12/1988 | LeBlanc et al. | 220/85 F X |

*Primary Examiner*—Dennis L. Taylor
*Assistant Examiner*—J. Russell McBee
*Attorney, Agent, or Firm*—Oblon, Spivak, McClelland, Maier & Neustadt

[57] ABSTRACT

A system for the storage and dispensing of liquid product from an underground installation comprises a storage tank which bears on its top a containment chamber enclosing all fittings for apparatus which gasoline or other stored product will pass through under pressure. Attached to at least one fitting each are a fill means for introducing liquid to the storage tank, and pumping means for pumping fluid therefrom, both of which are entirely enclosed in secondary containment, the storage tank itself and piping also being enclosed in secondary containment, such that the system is pressure tight, and recovers all leaked fluid in a state in which the fluid can be reused.

12 Claims, 5 Drawing Sheets

SYSTEM FOR UNDERGROUND STORAGE AND DELIVERY OF LIQUID PRODUCT, AND RECOVERY OF LEAKAGE

BACKGROUND OF THE INVENTION

1. Field of the Invention

This invention pertains to a system for the underground receipt and storage of liquid product, such as distilled petroleum products, e.g., gasoline. More specifically, it pertains to a system designed to connect an underground storage tank with an above-ground dispensing means, whereby all potential leaks in the system will be entrapped in a secondary containment and returned to a recovery tank, from which the product can be monitored or used.

2. Background of the Prior Art

Many liquid products are stored, for varying periods of time, in underground storage tanks and the like. A principal, but by no means limiting, example of such liquid is gasoline, along with other petroleum distillates. For dispensing at a service station, these products are generally loaded into an underground storage tank, from a tank truck or similar means, through a hose connecting the two. The product is dispensed from the storage tank to an above-ground dispensing means, usually with the aid of a submersible pump.

In recent years, increasing attention has been directed to the potential for environmental problems presented by such tanks and systems. Among the problems identified is the corrosion of the tank, and related materials, itself, generally presented by tanks constructed of steel materials, and similar corrosion-susceptible alloys. Thus, as discussed in U.S. Pat. Nos. 3,335,904 and 3,700,512, tanks comprised of corrosion-resistant material, which exhibits satisfactory stiffness and strength requirements, are increasingly adopted. One material widely used is fiberglass reinforced resinous material, for example, isophthalic resins.

While such tanks may be corrosion resistant, the possibility for leakage through the wall of the tank persists. Accordingly, certain jurisdictions have adopted regulations requiring the use of double walled tanks, such as that described in U.S. Pat. No. 4,676,093. A similar double-wall tank, comprised of steel, is disclosed in U.S. Pat. No. 1,886,074. In such double walled tanks, the annular space between the walls is generally occupied by a monitoring means of some sort, either a liquid, the level of which falls upon the development of a leak in either the inner or the outer tank, or a monitor, provided at the bottom of the tank, when installed, which will detect the presence of petroleum products thereat.

However, while considerable attention has been devoted to designing appropriate double-walled tanks of corrosion-resistant materials to reduce the potential for environmental hazard, relatively little attention has been paid to the commercial loss of product due to leakage in the system which places the storage tank in communication with the above-ground dispensing device, and the environmental hazard posed thereby. One attempt to address these problems is described in U.S. Pat. No. 4,639,164. Therein, "sumps" are provided on inlet and outlet fittings on the storage tank, which sumps are intended to catch or retain leakage at the fittings to the tank. However, the system fails to retain the material in such a fashion that it may be reused, cannot be used to monitor the amount and rate of leakage, and, to remove the leakage from the sump, requires a pump in an above ground holding tank. Moreover, the system described in U.S. Pat. No. 4,639,164, does not provide for, or describe, the means by which attachments to conventional equipment, such as submersible pumps, fill pipes and the like, may be made, and maintain the integrity of the system.

Accordingly, it remains an object of this technology to provide a complete system design for underground installation, for the containment and delivery of liquid product from an underground storage tank to an above-ground dispensing device, including means for filling the tank, and delivering the fuel to the dispensing means.

SUMMARY OF THE INVENTION

The system of this invention is designed for underground installation. It comprises, principally, an underground storage tank, preferably prepared out of corrosion-resistant material, although any storage tank may be used in conjunction with the system. The storage tank is provided with fittings. Those fittings which may be placed under pressure and pass liquid therethrough, thus raising the possibility of leakage from the fitting, are entirely enclosed within a secondary containment chamber placed on, and sealed to, the underground storage tank. A means for filling the storage tank is provided, which includes a spring actuated sleeve, which, when opened, rests against a shroud of corrosion-resistant material, so that the tank may be filled, and any spillage therefrom, or leakage of the fitting of the fill pipe, is recovered, in said secondary containment chamber. An additional fitting is contained within the secondary containment chamber, which fitting accommodates the riser for a submersible pump, which is similarly contained in a sealed vessel, of corrosion-resistant material. Contained piping, comprised of concentric primary piping, and secondary containment piping surrounding the primary piping, pass through the vessel, to the submersible pump, and from there to a dispensing means, which is generally located at or above ground. The junction between the piping system and the dispensing means may be at ground level. Underneath the dispensing means, in the ground, and coterminous, in length and width, with the dispensing means, is a drip or collection box, again made of corrosion-resistant materials, which will "catch" any leakage at the junction of the piping and dispensing means. As the level of the collected fluid rises, it will pass into the secondary containment piping, and under the influence of gravity, flow back to the containment chamber. All materials in the secondary containment chamber flow to a recovery tank.

DETAILED DESCRIPTION OF THE INVENTION

As noted above, the system, as a whole, provides for complete containment and recovery of any and all potential leakage of products stored underground. However, each component of the system can be retro-fitted to existing underground storage and dispensing systems, and may also be used independently. Thus, each aspect of the system is discussed, below, and then the operation of the system, as a whole, is considered.

The Storage Tank

The liquid product to be contained and dispensed through the system is temporarily stored in a storage tank 100, particularly designed for underground installation. For application where corrosion may be a problem, either from brine in the installation hole or from the liquid contained, the tank may be preferably comprised of a fiber reinforced resin composition. U.S. Pat. Nos. 3,335,904 and 3,700,512, noted above describe, in detail, the requirements and characteristics of such tanks.

Figure 2:
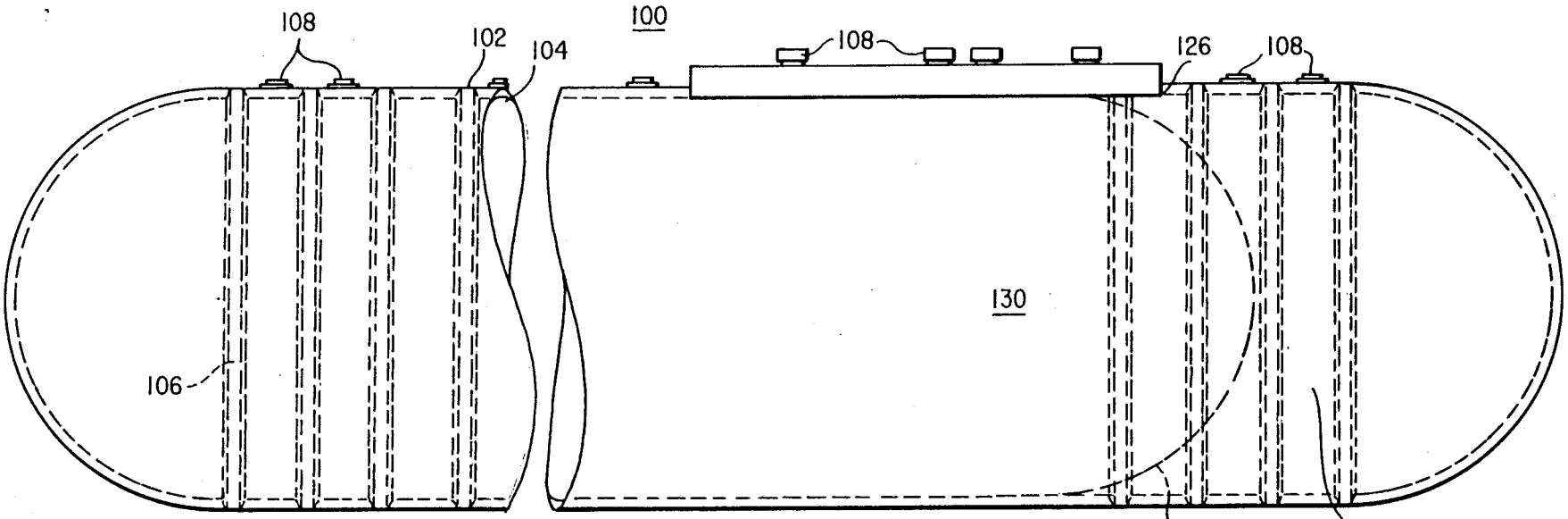
FIG. 2 is a side view of the underground storage tank of the system, provided with a secondary containment chamber and recovery tank.

The system of this invention makes possible complete recovery of leaked or spilled fluid from the system, wherever such leaks occur. The storage tank 100 is also susceptible to leakage due to breaks or cracks in the wall. To this end, the storage tank is preferably comprised, as illustrated in FIG. 2, of two walls, the space therebetween being preferably provided with a leak detection system. Thus, the tank conventionally comprises outer wall 102 and inner wall 104, spaced from each other and supported by ribs 106. The space between walls 102 and 104 may be empty or filled with a liquid as described in U.S. Pat. No. 4,676,093. In a particularly preferred embodiment, the space is occupied by a load transmitting, fluid-passing material such as a mineral wool felt. This type of tank is disclosed in a copending application to Robin Berg et al, U.S. application Ser. No. 444,807, filed Dec. 1, 1989 incorporated herein by reference.

Figure 1:
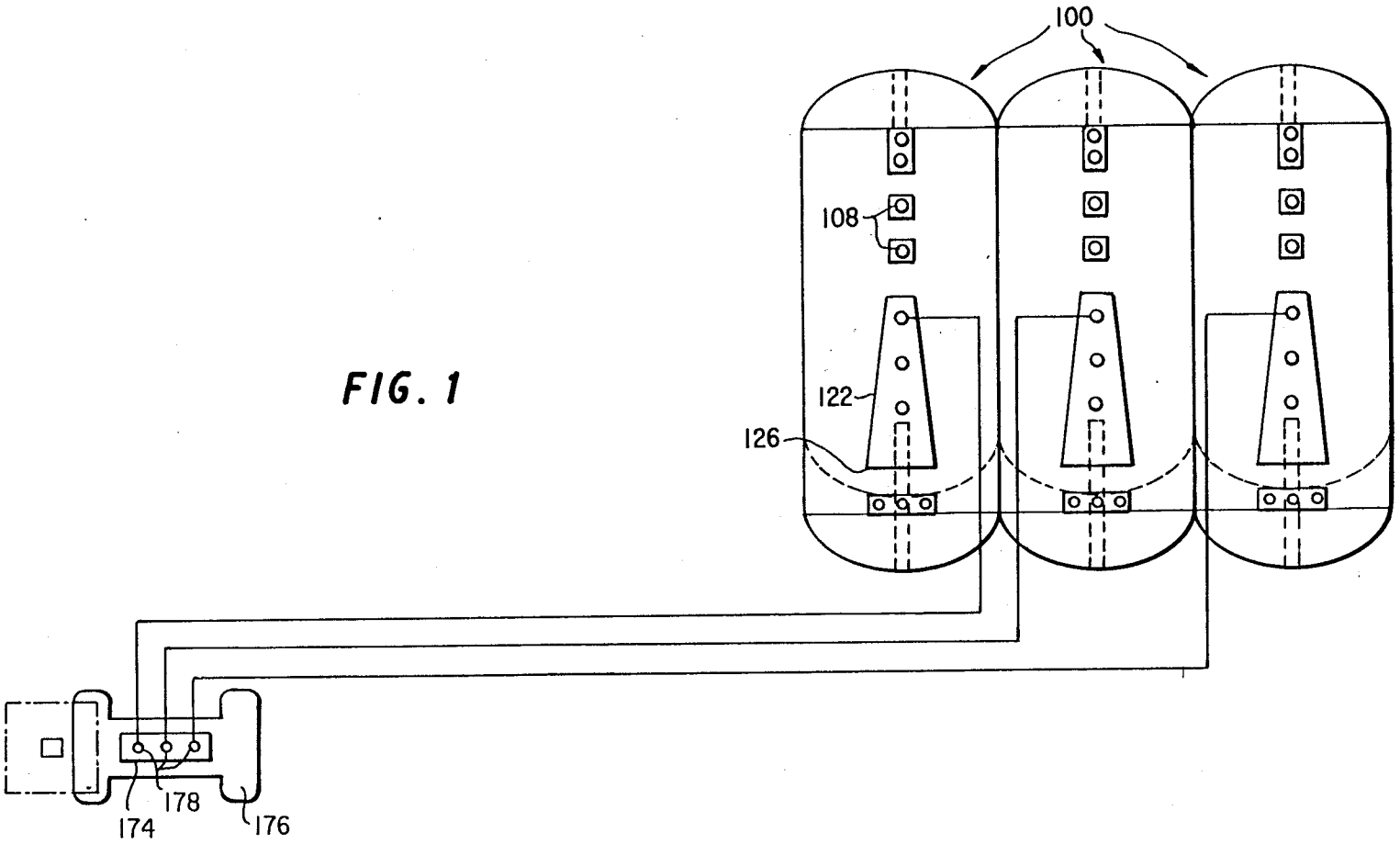
FIG. 1 is a schematic plan of the underground storage and dispensing system of the invention.

As particularly illustrated in FIGS. 1–2, the storage tank is provided with fittings 108 which will lie on the upper surface of the tank when installed. The installation of FIG. 1 is a typical installation for a gasoline service station, comprised of three tanks 100 which may hold similar or distinct products. A system within this invention may be comprised of one or more tanks.

Figure 3:
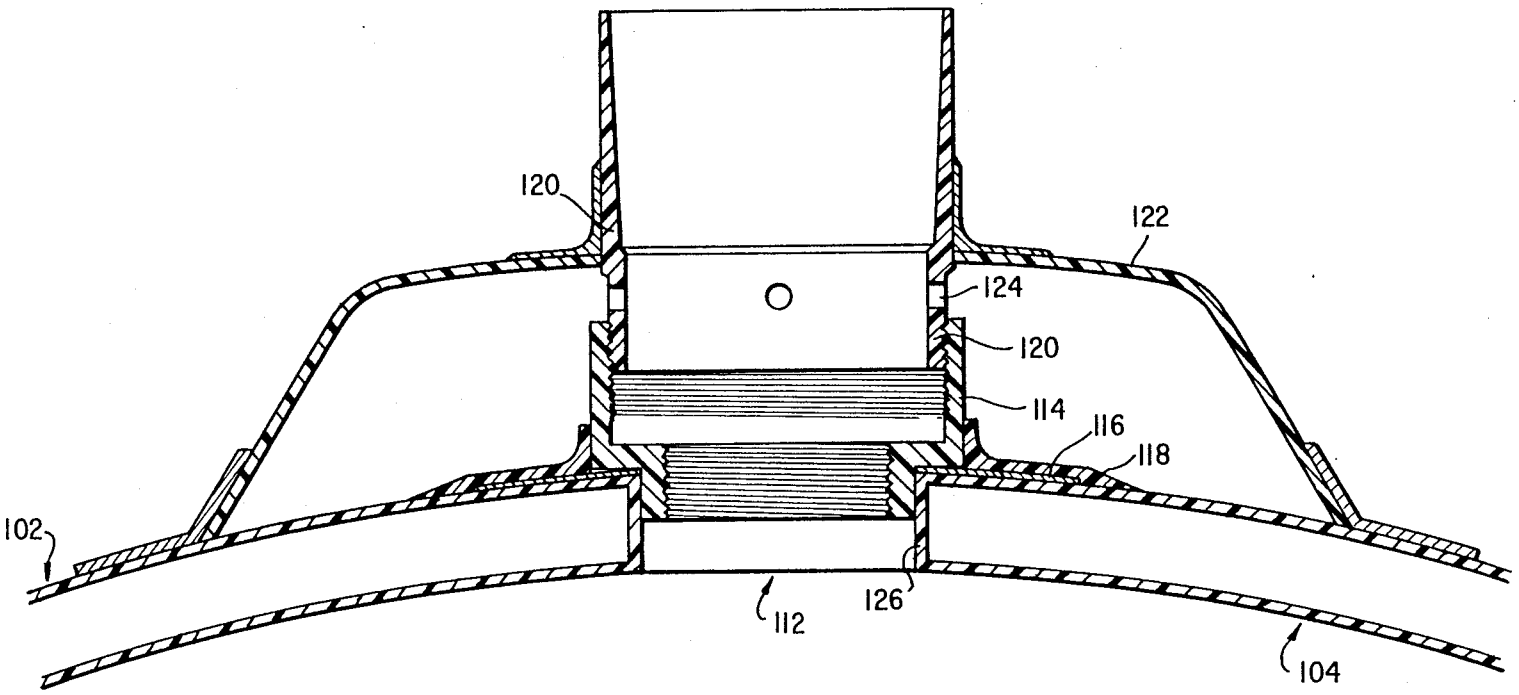
FIG. 3 is a cross-sectional view of a typical fitting for the underground storage tank of the invention.

The basis design of tank fitting 108, for receiving apparatus to fill or empty the tank, or otherwise treat the materials contained therein, is more clearly set forth in FIG. 3, which reflects the use of a double wall tank with exterior wall 102 and interior wall 104. A hole 112 through these places the tank interior in communication with whatever apparatus the fitting may receive. Seated on the edge of hole 112 is alloy bushing 114. When the tank wall is made of reinforced plastic, the bushing may be seated on an alloy plate 116, which is secured between wall 102 and extra reinforced resin ring 118. In conventional terms, the plate and bushing are "glassed" in, where the resin is reinforced with fiberglass.

Bushing 114 is pre-threaded at both ends. At its upwardly open end, the bushing receives a complementary threaded pipe or sleeve 120, which may be comprised of reinforced resin and which passes through and is sealed to a containment chamber 122, discussed in detail below, which entirely encloses the fitting and is sealed to the top of the storage tank 100.

In practice, the lower threaded end of bushing 114 will receive a complementary threaded end of the apparatus received, as detailed below. By this arrangement, the fitting itself is always provided with a containment system, so, should a leak develop, the liquid will not pass to the environment. Sleeve 120 surrounds the fitting itself. Surrounding sleeve 120 is a containment chamber 122. There is a port 124 in sleeve 120 that communicates with chamber 122. In actual installation, sleeve 120 may bear three or more ports 124. If product leaks from the fitting, it will be contained within sleeve 120, and will accumulate at the threaded fitting. As the accumulated product builds up, it will spill over port 124 into containment chamber 122.

It should be noted that the storage tank 100 can be molded up with bushing, glassing in reinforcements and sleeves as necessary, using either male or female molding processes. In either event, hole 112 is sealed off from the space between walls 102 and 104 by circumferential wall 126.

Containment Chamber

The containment chamber 122, is defined by a wall best illustrated in FIG. 1, comprised of reinforced resin made of material which may be similar to that of tank wall 102, to which the chamber is sealed in a pressure tight fashion. The chamber is on that portion of the tank, that, when installed, will be uppermost. Preferably, the storage tank is of cylindrical design, or where the upper surface otherwise defines a dome, such that the containment chamber may be advantageously shaped as a trapezoid. This ensures draining of any product in the chamber to two points designated collection points. Leaking fluid will collect at these points owing to the curve of the tank, and may be transferred from there to a recovery means, such as a secondary tank.

As illustrated in FIG. 2, in a preferred embodiment, recovery tank 128 may be conveniently integral with storage tank 100, and in fact, a portion thereof. The internal space 130 of storage tank 100 is separated from recovery tank 128 by internal wall 132. In this preferred embodiment, collection points 126 drain directly through walls 102 and 104 of storage tank 100, through holes therein, directly into recovery tank 128. Such a design allows one to monitor the rate and amount of product recovered, without installation of a separate chamber, or the requirement of additional pumps, to remove the accumulated liquid.

Alternatively, a remote recovery tank may be provided, so long as it is lower, when installed, than collection points 126, so that the entire system may drain unassisted under the influence of gravity. Of course, if desired, the recovery tank may be located above the collection points, and a pump used.

In situations when recovery of product which has leaked out of the primary system need not be monitored, recovery may be directly into the interior 130 of storage tank 100. In this event, internal wall 132 is not present. It should be noted that the design of this system, which ensures complete containment of any leakage or spillage in a pressure tight fashion, ensures that any recovered product will not be mixed or contaminated with water, dirt or other materials. Accordingly, it can be used directly, if monitoring is unnecessary. It should be stressed that containment chamber 122 encompasses all fittings through which gasoline or other stored product may pass, particularly under pressure.

Each tank and containment chamber will enclose the fittings for at least two apparatus—a means for filling the tank and a means for dispensing liquid from the tank (e.g., a submersible pump). These are discussed below. However, the tank is generally provided with additional fittings, to receive other attachments. If stored liquid will pass through these fittings they will be enclosed within containment chamber 122.

Additional attachments which may be received by such fittings include annular space monitors, vent and vapor recovery devices, an electronic tank gauge, vapor recovery jet pump, a fitting for a pump to empty the tank, other gauges and monitors as desired.

Fill Means

As noted above, one source of potential leakage is the means used to fill storage tank 100 from above ground, as through a hose attached to a tank truck carrying the liquid. Even of no liquid is deliberately spilled at the conclusion of the filling operation, the fitting of the fill pipe connection to the storage tank is under pressure, and fluid may spray out, in ordinary operation. The filling apparatus of the system of this invention overcomes both this source of loss, as well as deliberate spillage of excess liquid contained in the hose, once the storage tank has been entirely filled.

Figure 4:
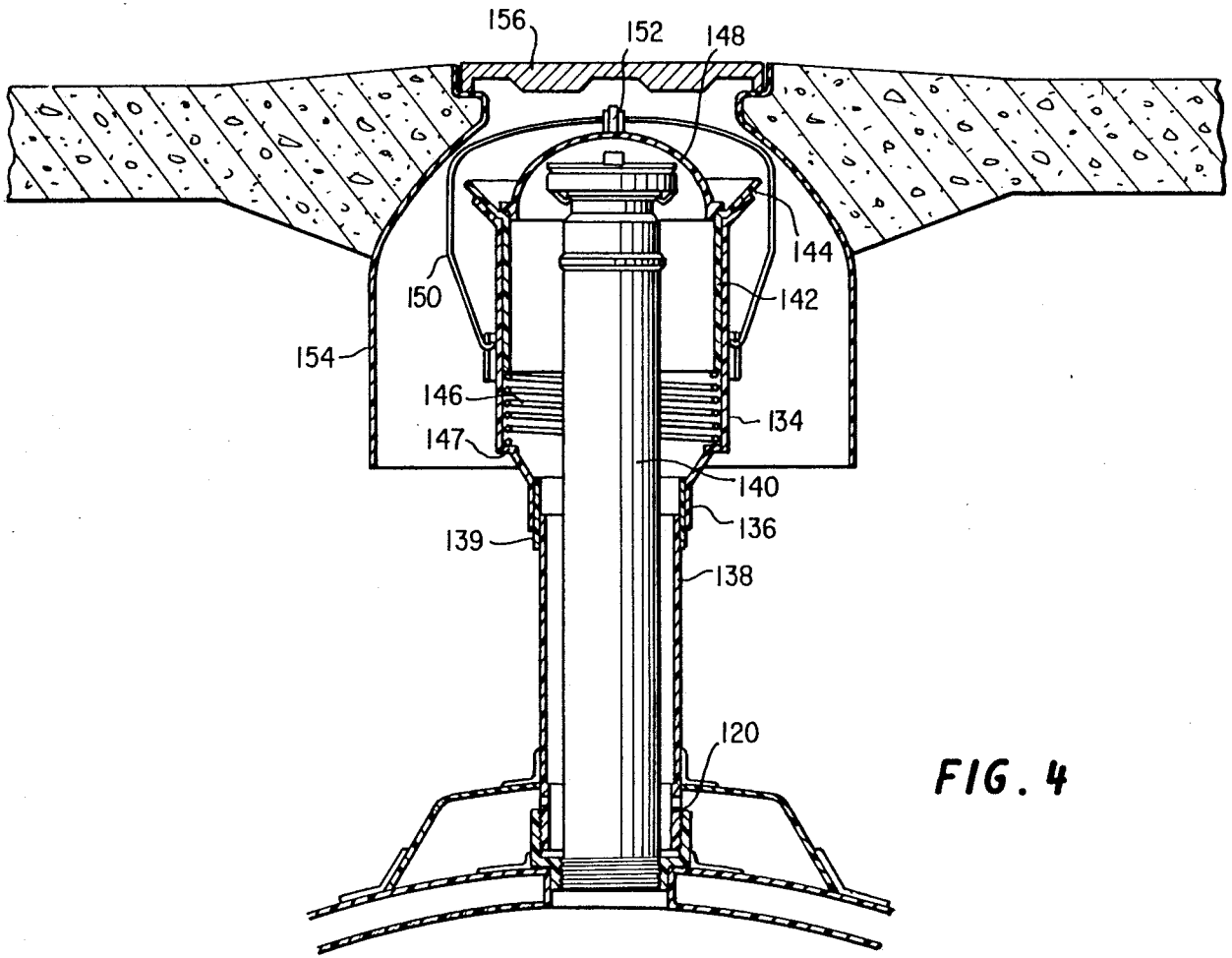
FIG. 4 is a cross-sectional schematic view of the filling means for the storage tank including the fitting therefor.
Figure 5:
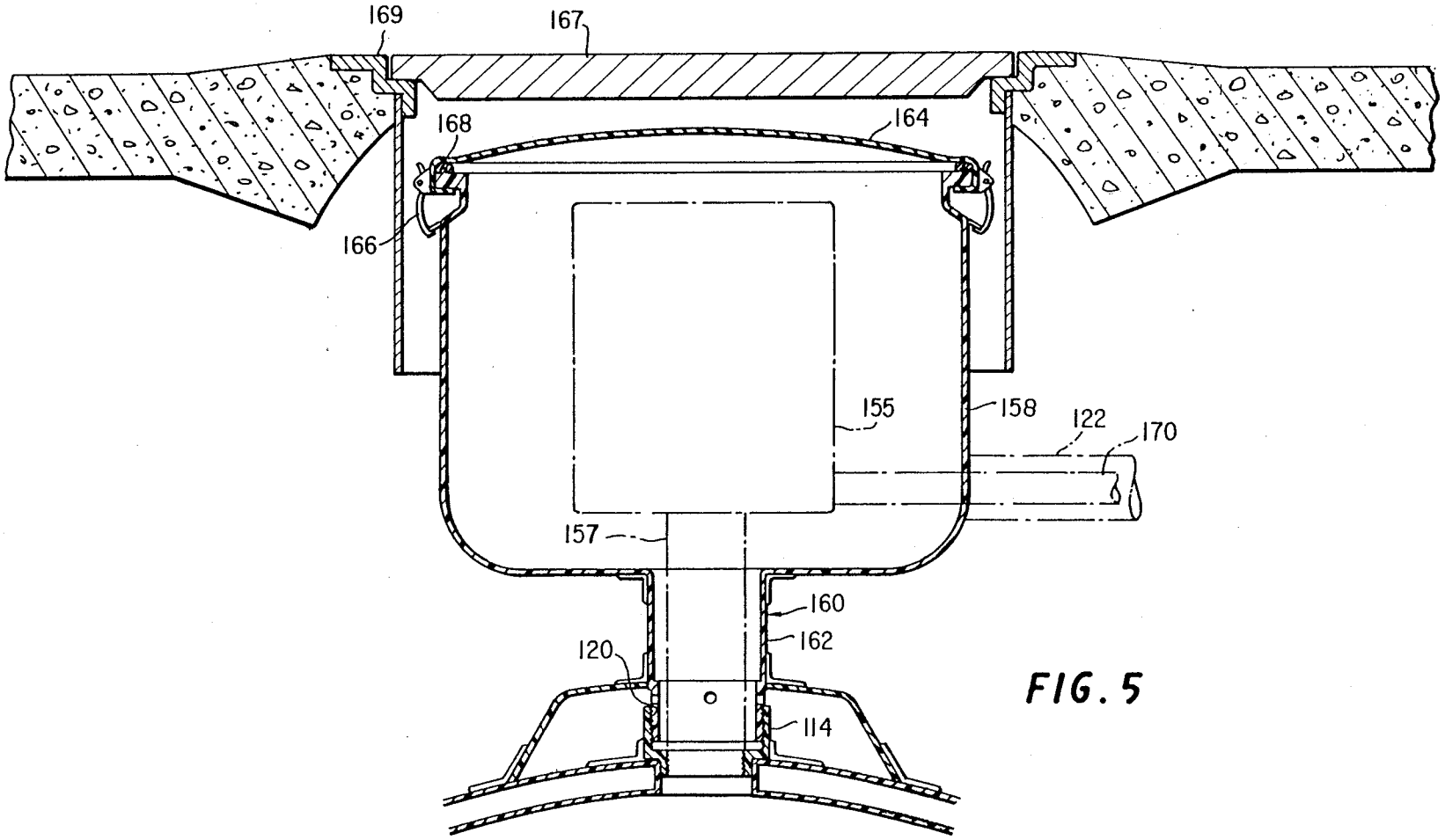
FIG. 5 is a cross-sectional view of the submersible pump and containment means therefor of this invention.

As best illustrated in FIG. 4, the fill means of this invention lies within outer pipe 134. Outer pipe 134, of reinforced resin material similar to sleeve 120 terminates in a vertical flange 136 which is sealed to an adaptor sleeve by gasketing and attachment materials 139, of reinforced resin. Adaptor sleeve 138 fits tightly into sleeve 120, which widens slightly toward its upper end. The adaptor sleeve may be trimmed at the installation sight, and the sleeve 120 and adaptor 138 are sealed with an application of resinous material.

Within outer pipe 134 is fill pipe riser 140, bearing at its upper end a mate for the hose to be attached, and threaded at its lower end, to the lower threads of fitting 110.

At the upper end of outer pipe 134, and slidably contained therein, is drip ring 142. The upper end of drip ring 142 terminates in an outward flaring collar 144. At its lower end, ring 142 rests on springs 146, which urge ring 142 against cover 148, held in place by spring lock 150 mounted on the side of outer pipe 134. Springs 146 may be secured to outer pipe 134 by feet 147. When spring lock 150 is rotated away, latch 152 is opened, and cover 148 may be removed and springs 146 urge ring 142 upwardly, so that collar 144 contacts shroud 154, surrounding the upper portion of outer pipe 134 and creating a cavity for the filling means. To remove cover 148, the overlying manhole 156 (aluminum alloy resting on a cast iron bushing) is lifted, cover 148 is exposed, and lifted away, thereby providing access to riser 140 and fittings for the hose. When filling is completed, the cover 148 is resealed onto ring 142, creating a pressure tight seal, which ring 142 is depressed and locked into place by latching spring lock 150 back into latch 152.

It will be noted that whether liquid is dumped at the conclusion of the filling operation, leaks from the joint of the hose with fill pipe riser 140, leaks at the threaded of fitting 108, or anywhere therebetween, the liquid will flow down in the inside of outer pipe 134, the sleeve 120, spilling over port 124 into containment chamber 122, and thence to recovery tank 128. Since it is sealed off from water, dirt and other contaminants, once recovered the leaked material can be reused.

A further advantage secured from this arrangement lies in the fact that water and other liquids collecting at manhole 156, when cover 145 is locked in place, can pass between shroud 154 and the end of collar 144 and thus into the surrounding dirt, rather than accumulating at the manhole. This avoids the need to provide a watertight seal for manhole 157, and avoids contamination of the contained liquid, a problem encountered in the art when seals fail, the manhole is opened, or condensation occurs.

Submersible Pump

In order to transfer liquid products such as gasoline from the storage tank to the dispensing means, a submersible pump is provided on one of the fittings 108 within the secondary containment chamber 122. The pump itself is of conventional design.

The pump 155 rests on riser 156 which again is threaded into the lower end of threaded bushing 114. The pump, and that portion of the riser above sleeve 120 are completely contained within sealed shell 158, which attaches to sleeve 120 in much the same way that outer pipe 134 attaches to its fitting. Specifically, shell 158 terminates in a horizontal flange 160 which is sealed to adaptor 162 by gaskets and adhesive. Adaptor 162 fits tightly into sleeve 120, and is sealed thereto by application of resinous material. Trimming of adaptor 162, insertion into sleeve 120 and sealing the connection are preferably done at the installation sight.

Shell 158 is fitted with a sealed but removable lid 164. Both shell and lid are comprised of reinforced resinous material. A pressure-tight seal of lid 164 to the shell is achieved through the use of conventional materials, such as plurality of snap latches 166 and a gasket 168 of, e.g., styrene-butadiene rubber. When unsealed, the lid provides access to the pump, achieved by lifting off an overhead manhole cover 167 supported on a fiberglass reinforced resin shroud 169, to form a cavity about the upper portion of the shell just as in the case of the fill means previously described.

Figure 7:
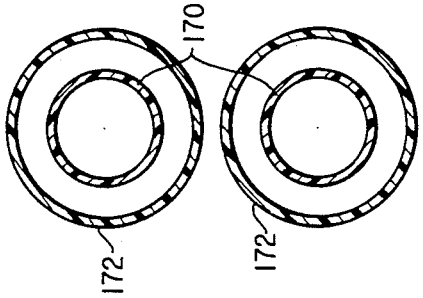
FIGS. 6 and 7 are cross-sectional views of piping useful in conjunction with the system.
Figure 6:
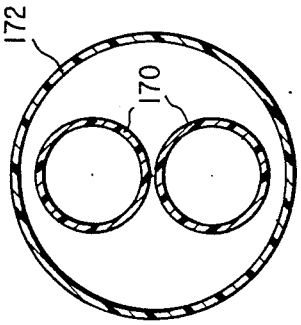

Penetrating through the shell is double walled piping, such as that shown in cross-section in FIGS. 6 and 7. The piping is comprised of primary pipe 170 and containment pipe 172. Each primary pipe 170 may be associated with a separate containment pipe 172, or a plurality of primary pipes 170 may be enclosed in a single secondary containment pipe 172, as illustrated in FIGS. 6 and 7, respectively. In view of its easy commercial availability, piping as illustrated in FIG. 6 is preferred. The joint where secondary piping 172 enters shell 158 is sealed to maintain the system pressure tight. The shell, lid and piping all preferably comprise cured fiberglass reinforced resin materials, or other materials resistant to corrosion and of high strength. Within shell 158, primary piping 170 may be attached to the pump 155 by conventional means, as this attachment is entirely encased within the shell, and thereby contained.

Piping

To carry the fluid from the tank and attachments to the dispensing device, piping of the type discussed above and illustrated in FIGS. 6 and 7 is used. This ensures that, should there be a leak in the primary piping, or leaking around the primary piping attachment at either end, the leak will be contained within the secondary or containment pipe 172, and returned to the fitting, the containment chamber 122, and eventually to the recovery tank 128. Since the pipe runs from an underground installation upward to the dispensing device, all return flow can be achieved under gravity alone.

At the point of attachment of primary and secondary containment piping 170 and 172 to dispensing means 178, which is supported on island 176, there is a drip or catch pan 174. Drip pan 174 is seated in the ground under dispensing means 178 and sealed thereto, and is coterminus therewith in length and width. Thus, any leakage or spray at the connection of primary piping 170 with dispensing means 178 will fall into catch pan 174, rising to the level of the attachment of secondary containment pipe 172 to the drip pan. Upon reaching this level, the recovered fluid will run back to the recovery tank, through the submersible pump fitting. Again, the drip pan is comprised of corrosion resistant material such as fiberglass reinforced resin and the like.

It should further be noted that any leak occurring above-ground in the dispenser chamber will be collected in drip or catch pan 174, and thus contained and returned to the system. In light of the abundance of piping joints, for meters and the like, present in the dispenser, this is a likely leak zone. The system of this invention, although installed below ground, is capable of recovering this likely source of above-ground leakage.

Operation of the System

In operation, fluid is loaded into the storage tank through fill riser 140. Any spray at the fitting of the riser to the containment tank, and bushing 114, is trapped in containment chamber 122, and thus directed to the recovery tank. When the above-ground dispensing device is operated, submersible pump 155 draws liquid from the storage tank and passes it through primary piping 170 to the dispensing means 176. It is noted that the juncture between the piping and submersible pump, and the piping and the dispensing means, is under considerable pressure. However, any spray or leakage at those connections is entirely contained within the shell 158 and catch pan 174 and is thereby returned, through fitting 108 supporting the submersible pump, and from the drip pan through containment piping 172, and thus back along the same route. As designed, the system is entirely pressure tight. Thus, integrity of the system can be monitored simply by applying a backward pressure along the piping. A leak at any point in the outer containment system will be determined by a loss of pressure. At the same time, the system, as described, can be employed with virtually any storage tank of conventional design, and does not generate significant additional expense, either in preparation, or installation.

The above invention has been disclosed with regard to specific embodiments, structures, and attachments. Unless otherwise indicated, these are not intended to be limiting, and equivalent means for achieving the same functions, operating in similar fashion, are embraced thereby. It should be further noted that each attachment described above may be procured and used, without the entire system, without departing from the scope of the invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A system for the underground storage of liquid product and delivery of said product to an above-ground dispensing means, comprising:

an underground storage tank provided with at least first and second fittings, to receive a means for filling said storage tank and means for pumping product from said storage tank to said dispensing means, respectively, both said fittings being entirely contained within a secondary containment chamber mounted on and sealed to said storage tank, fill means comprising an adaptor in sealed communication with said first fitting, said adaptor bearing an outer containment pipe which, together with said containment chamber completely encloses a fill means riser for attachment to a means for delivering a product to said riser, said riser being in fluid communication with said storage tank, means for pumping product from said storage tank to said above-ground dispensing means, said pumping means being entirely contained within a shell having a pressure tight, removable lid providing access to said pumping means, said shell being in pressure tight liquid communication with said second fitting and passing through and sealed to said secondary containment chamber, piping means being attached to said pump means and penetrating through and sealed to a wall of said shell, said piping means comprising concentric primary piping and outer containment piping, said piping means terminating at a point for connection to said aboveground dispensing means, which point of termination is enclosed by a drip pan coterminous with the length and width of said dispensing means, said system being pressure tight.

2. The system of claim 1, wherein the storage tank is comprised of concentric inner and outer walls, with an annular space therebetween.

3. The system of claim 2, wherein said annular space is occupied by a load transmitting material through which a fluid selected from the group consisting of aqueous solutions and petroleum products will pass under the influence of gravity.

4. The system of claim 2, wherein said outer wall is spaced from said inner wall by external ribs integral with said inner wall.

5. The system of claim 1, wherein said outer containment pipe of said fill means further comprises an interior sleeve slideably mounted therein, exterior to and concentric with said riser, said interior sleeve being mounted on means for urging said sleeve upward such that said interior sleeve is urged against a cover which may be sealed to said containment pipe, and when said cover is removed, said interior sleeve is urged against a shroud overlaying said fill means.

6. The system of claim 5, wherein said means for urging said interior sleeve upward comprises springs fixably mounted on the interior of said containment pipe.

7. The system of claim 1, wherein the portion of said tank which, when installed, is uppermost, is dome-shaped, and said containment chamber is placed thereon and trapezoidal in shape, said containment chamber comprising a plurality of drain holes at the lowest points of said containment chamber, when said tank is installed.

8. The system of claim 7, wherein said drain holes are in direct fluid communication with a recovery tank integral with said storage tank but separated from that portion of said storage tank which said fill means riser is in fluid communication with by an interior wall.

9. The system of claim 7, wherein said drainage holes lead directly to the interior of said storage tank, which said interior is undivided.

10. The system of claim 7, wherein said drain holes are in fluid communication with piping which empties into a recovery tank separate from said storage tank.

11. A system for the underground storage of liquid products and delivery of said product to an above-ground dispensing means, comprising: an underground storage tank provided with at least first and second fittings, to remove a means for filling said storage tank and means for pumping product from said storage tank to said dispensing means, respectively, both said fittings being entirely contained within trapezoidal secondary containment chamber mounted on and sealed to said storage tank, said containment chamber comprising a plurality of drain holes at its lowest points, as installed, fill means comprising an adapter in sealed communication with said first fitting, said adapter bearing an outer containment pipe which, together with said containment chamber completely encloses a riser for attachment to a means for delivering a product to said riser, said riser being in fluid communication with said storage tank, means for pumping product from said storage tank to said above-ground dispensing means, said means for pumping being in fluid communication with said above-ground dispensing means.

12. A system for the underground storage of a liquid product and delivery of said product to an above-ground dispensing means, comprising: an underground storage tank provided with at least first and second fittings, to receive a means for filling said storage tank and means for pumping product from said storage tank to said dispensing means, respectively, both said fittings being entirely contained within a trapezoidal secondary containment chamber mounted on and sealed to said storage tank, said second containment chamber being a plurality of drain holes at its lowest points, as installed, fill means for filling said storage tank with liquid product, means for pumping product from said storage tank to said above-ground dispensing means, said pumping means being entirely contained within a shell having a pressure right, removable lid providing access to said pumping means, said shell being in pressure tight liquid communication with said second fitting and passing through and sealed to said secondary containment chamber, piping means being attached to said pump means and penetrating through and sealed to a wall of said shell, said piping means being in fluid communication with said dispensing means. through and sealed to a wall of said shell, said piping means being in fluid communication with said dispensing means.

* * * * *